US005435010A

United States Patent [19]

May

[11] Patent Number: 5,435,010

[45] Date of Patent: Jul. 25, 1995

[54] MOISTURE SENSITIVE ARTICLE OF CLOTHING AND METHOD OF MANUFACTURING THE SAME

[76] Inventor: Robert E. May, 1013 Tempo Dr., Creve Coeur, Mo. 63146

[21] Appl. No.: 137,552

[22] Filed: Oct. 18, 1993

[51] Int. Cl.[6] ..... A41D 7/00

[52] U.S. Cl. ..... 2/67; 2/1; 2/243.1; 252/408.1; 8/637.1; 604/361; 428/29; 428/913; 116/206; 116/207

[58] Field of Search ..... 2/67, 69, 115, 1, 243.1; 106/21 R, 21 A; 252/408.1; 8/637.1; 604/361; 428/29, 913; 116/206, 207

[56] References Cited

U.S. PATENT DOCUMENTS

| | | | |
|---|---|---|---|
| 3,675,654 | 7/1972 | Baker et al. | 604/361 |
| 3,847,139 | 11/1974 | Flam | 128/2 H |
| 4,507,121 | 3/1985 | Leung | 604/361 |
| 4,510,188 | 4/1985 | Ruggeri | 428/1 |
| 4,642,250 | 2/1987 | Spector | 2/67 |
| 4,725,462 | 2/1988 | Kimura | 428/29 |
| 4,744,113 | 5/1988 | Kogut | 604/361 |

FOREIGN PATENT DOCUMENTS

| | | | |
|---|---|---|---|
| 2541872 | 9/1984 | France | 604/361 |

*Primary Examiner*—Clifford D. Crowder
*Assistant Examiner*—Gloria Hale
*Attorney, Agent, or Firm*—Steven G. Saunders

[57] ABSTRACT

An article of clothing that changes color when exposed to varying moisture levels within the article. The article has a body with an outer surface, and a moisture sensitive coating disposed upon the outer surface of the body that changes color when in contact with varying moisture levels in the body.

14 Claims, 3 Drawing Sheets

MOISTURE SENSITIVE ARTICLE OF CLOTHING AND METHOD OF MANUFACTURING THE SAME

FIELD OF THE INVENTION

This invention relates generally to an article of clothing, and more particularly concerns an article of clothing that changes color and yields various designs when exposed to varying moisture levels within the article's fabric body.

BACKGROUND OF INVENTION

Apparel designers, manufacturers, and retailers are continually researching and developing new types of garments that they hope will spawn the next significant fashion trend. Advertisers and large companies that have made substantial investments in logos and trademarks are similarly searching for new and innovative methods of advertising that will display their mark to the consumer market. The two groups commonly cooperate by placing company logos directly onto apparel. Such cooperation gives advertisers inexpensive mass advertising for their client companies, as it gives apparel retailers a popular name to place upon the garment, thus increasing the ultimate asking price. Increased revenues are therefore realized for both parties. It is very common, for example, for a person to wear a shirt bearing the logo of his or her favorite N.F.L. football team across the chest of the shirt. Such a shirt increases the public exposure of the N.F.L. team, as it increases the asking price of the shirt. Both parties receive a corresponding benefit.

There are no known garments or articles of clothing that change color when exposed to higher or lower moisture levels. Such garments could be manufactured to display different company logos or designs. This type of garment could be used to advertise company logos or merely as a novelty item. Such a garment has many practical applications, including use as a swimsuit, bathing suit, wet suit, scuba diving suit, surfing suit, or other water sport uniform. It can also be used as a casual or formal garment.

Garments that respond similarly to temperature fluctuations by changing colors are known in the art. When the garment reaches a predetermined temperature, it maintains a first color that changes as the garment warms. Such a garment is distinct from a moisture sensitive garment in that it requires a different stimulus to trigger the color change. Temperature sensitive dyes are required to effectuate such a reaction.

Inks and dyes that change color when exposed to varying moisture levels are known per se in the art. U.S. Pat. No. 4,990,284, issued Feb. 5, 1991 to Lauterbach et. al., discloses various known types of inks and dyes that exhibit this property. Lauterbach specifically discloses a moisture indicating ink that is printed upon a substrate that changes colors at a preselected ambient moisture. This device is generally used as a visual moisture indicator to alert users to extreme moisture levels in packaging. The freshness of the packaged product is then easily determined without having to open the package. One example disclosed is a conventional cigarette package. Lauterbach neither discloses nor hints at utilizing this type of ink in connection with an article of clothing. Such a use as disclosed in Lauterbach is quite different, functionally and aesthetically, to using this ink in connection with an article of clothing.

Boehland, U.S. Pat. No. 4,277,848, discloses an athletic jersey that changes colors by changing panels. Such a jersey requires the user to manually attach and separate panels from an outside portion of the jersey. Accordingly, such a jersey requires its user to manually operate upon the panels of the jersey to effectuate a color change. No color change arises via an automatic reaction with water or other fluid.

Packler et al, U.S. Pat. No. 3,738,299, disclose applying phosphorescents to fabrics for glow in the dark designs. Such a device does not result in any color or design change upon the face of a treated garment as a result of a reaction with water. The required stimulus in this disclosure is the strength of light.

Martone, U.S. Pat. No. 2,228,033, discloses an invisible ink for fabrics and paper that becomes visible when wet. Applying such an ink to fabrics merely results in causing an invisible ink to become visible when wet. Since the invisible ink is colorless prior to saturation, there is no identifiable, reversible color change from one color to another. No identifiable design or color change is disclosed, specifically for use in conjunction with an article of clothing, bathing suit, or the like.

Tronstau, U.S. Pat. No. 2,210,862, discloses adding a moisture indicating substance to a gel substance that is placed within a shoe. The gel substance is added to the shoe as a moisture absorber. The moisture indicating substance is red when saturated with humidity and deep blue when dry. Such a device has no color changing effect upon the outside or inside of the shoe itself in that it acts only within the gel substance.

Accordingly, there is a need for an article of clothing that reacts with varying moisture levels to change the color and/or design upon a surface of the article. Such an article could be imprinted with popular logos and trademarks, thus creating new and inexpensive publicity for trademark owners or the like, while increasing the asking price and quantity of the article sold. Even without logos or trademarks upon the surface of the article, such a color change upon the article creates a new novelty item, thus resulting in new clothing lines to perhaps spawn the next fashion trend.

SUMMARY OF INVENTION

It is therefore an object of this invention to create a new and useful means of advertising for services, items, or the like, associated with logos or trademarks.

It is another object of this invention to create a new novelty item that could perhaps spawn a new or different fashion trend.

It is a further object of this invention to create an article of clothing that changes color when exposed to varying moisture levels.

It is also an object of this invention to develop a method of manufacturing an article of clothing that changes color when exposed to varying moisture levels.

It is another object of this invention to create a bathing suit that appears different after being used in water.

It is yet another object of this invention to create an article of clothing that appears to be different after being exposed to varying moisture levels.

It is still a further object of this invention to create an article of clothing that displays various designs upon a face of the article, where each design is visible at distinct moisture levels within the article.

This invention results from the realization that an article of clothing can be manufactured to change color or the design upon its face, outside, or inside surface by applying a moisture sensitive ink or dye coating to the fabric of the article. Such a device can be utilized as a mass advertising means, or merely as an article of clothing or swimsuit that can be used as any other similar article of clothing.

This invention consists essentially of an article of clothing that has a body with an outer surface, and a moisture sensitive colored coating disposed upon the outer surface of the body. The coating, which can be either permanently or non-permanently applied to the body, is comprised of an ink, dye, inorganic compound, or the like that has the property of changing color when in contact with varying moisture levels present in the body. The body can be fabric, plastic, rubber, or any other material that can be effectively used in designing an article of clothing. The coating can be applied to the body as a plurality of distinct moisture sensitive dyes. Each distinct dye is disposed upon a distinct portion of the outer surface of the body to create a moisture sensitive color change that varies about the outer surface of the body. Such a variable color change is designed such that a first design is present when the article is wet, and a second design is present when the article is dry. The color change can also be designed so that a plurality of designs are visible at distinct moisture levels in the body. The variable color change can similarly be applied to an inner surface of the body to yield the same effect.

An article of clothing that changes color when exposed to varying moisture levels can be manufactured by providing a fabric with an inner and outer surface, applying a permanent moisture sensitive dye coating to the outer surface of the fabric that is capable of changing color when exposed to varying moisture levels, cutting the fabric to a specific shape, and sewing the fabric. The additional step of applying a permanent design to the outer surface of the fabric that is visible only when the coating is reacting to a high or low moisture level, whichever the article's designer selects, can be added to the method of manufacturing the article of clothing. Such an article can be sewn into the form of a bathing suit.

A bathing suit comprising a fabric body with an outer surface, a first design disposed upon the outer surface, and a moisture sensitive dye coating disposed upon the outer surface of the body that changes color when exposed to varying moisture levels in the fabric body is similarly disclosed. Such a bathing suit can be set to make the first design visible only when the body is either saturated, dry, or both. A plurality of designs disposed upon the outer surface can similarly be disposed upon the body, where the designs are visible at distinct moisture levels in the fabric body. The moisture sensitive dye is preferably permanent and the design can be a picture.

DISCLOSURE OF PREFERRED EMBODIMENT

Other objects, features, and advantages of this invention will occur to those skilled in the art from the following description of a preferred embodiment and the accompanying drawings, in which.

Figure 1:
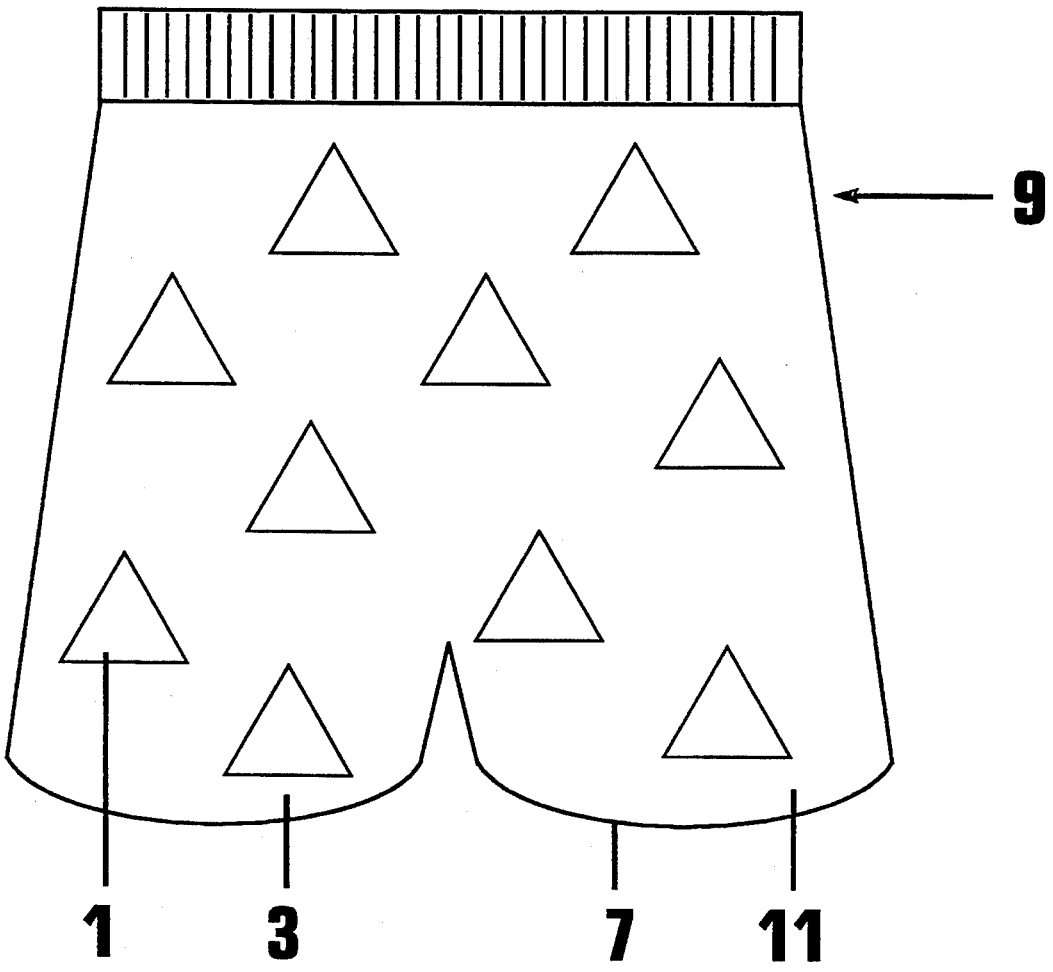
FIG. 1 is an illustration of an article of clothing having a first design when dry.
Figure 2:
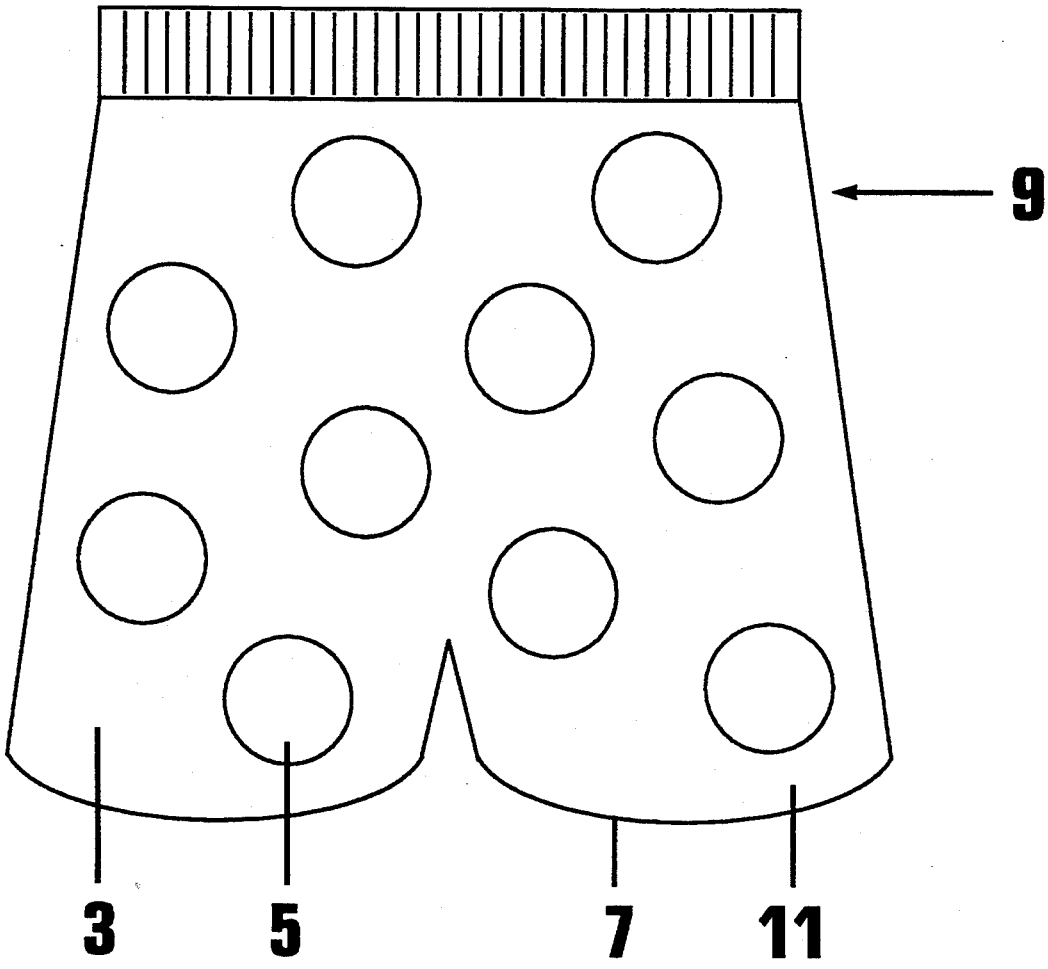
FIG. 2 is an illustration of the article of clothing of FIG. 1 when wet or saturated at higher moisture levels. The article bears a second design that is distinct from the first design in FIG. 1.

There is shown in FIG. 1 article of clothing 9 that has a first design 1 upon an outer surface 3 when dry. FIG. 2 shows the same article after being exposed to a higher moisture level, preferably after being saturated with water or other liquid. A second design 5 of FIG. 2 is different than design 1 of FIG. 1, thus giving the illusion of article 9 being a new or different article of clothing. Such a design change occurs when either a permanent or non-permanent reversible moisture sensitive dye or ink coating 11 that is applied to article body 7 changes color after being exposed to higher moisture levels within body 7. Article body 7 can be fabric, rubber, plastic, or any other material that can be effectively used in designing an article of clothing.

There is no necessity that there be a design upon outer surface 3 of body 7. A mere color change upon outer surface 3 of body 7 will suffice. Furthermore, article 9 can have a design upon outer surface 3 when dry that disappears when wet and reappears when dry. Similarly, article 9 can have a design upon outer surface 3 when wet that disappears when dry and reappears when wet.

Moisture sensitive dye or ink coating 11 that is applied to body 7 must be carefully selected to yield the proper color change when the design upon outer surface 3 is pre-set to change form. Improper dye selection can cause resulting designs to be indistinct, not visible, or distorted. Inks or dyes such as those disclosed in Lauterbach et.al. can be used to accomplish this function. Such inks, dyes, or other functionally equivalent inks or dyes are formulated to yield proper colors when exposed to varying moisture levels. Inorganic hydrate compounds or the like can also be used as coating 11 to effectuate a reversible color change. Such a coating 11 can be applied in microbead or other form. Inks using cobalt chloride as the color changing ingredient, alcohol the carrier, and cellulose derivatives as the binder can further be used.

Various different color combinations can be applied to different patches of outer surface 3 of body 7 to give a multi-color change upon body 7. This allows the designs to be more complex, thus giving article 9 a more flexible, wider array of possible designs that can practically be affixed to the body. It can further be utilized to yield very detailed designs using dye coating 11 alone. No design would be necessary to be imprinted upon outer surface 3 of body 7 since the individual dyes would be placed such that a design appears that is made up solely of the arrangement of the different colored dyes.

EXAMPLE I

A moisture sensitive dye coating is applied to a fabric body of a pair of shorts. The dye coating is applied in patches, such that when dry, the dye is solid blue. When the moisture sensitive dye coating is exposed to a higher moisture level of approximately 85% saturation, the body color remains blue in all spots except for the front left leg. The front left leg thus yields a 2 inch by 2 inch logo of the Dallas Cowboys TM football team. When the pair of shorts dries, the Dallas Cowboys TM logo disappears and the article once again returns to solid blue.

EXAMPLE II

The same pair of shorts of Example I, except that when dry, the shorts have a 2 inch by 2 inch New England Patriots TM football team logo upon the front right leg of the shorts. When saturated with water, the New England Patriots TM football logo disappears and the Dallas Cowboys TM logo appears. Similarly, after the shorts dry, the Dallas Cowboys TM logo disappears and the New England Patriots TM logo reappears.

It is known in the art that certain colors can be combined to yield a neutral color. This concept is further utilized in article 9 to mask or hide permanent designs "behind" or "below" coating 11 of moisture sensitive dyes, inks, or the like. When exposed to a different moisture level, the dyes or inks change to a predetermined color, preferably a color that does not adversely react with the below design, thus highlighting the design. Dye coating 11 must be chosen carefully so that it serves the dual function of masking hidden design 1 when in one moisture sensitive phase, and highlighting design 1 when in an opposite moisture sensitive phase. This process can also be accomplished with two separate designs simultaneously, where design 1 is visible when article 9 is in one moisture sensitive phase, and second design 5 is visible when article 9 is in an opposite moisture sensitive phase.

EXAMPLE III

A moisture sensitive dye coating is applied to a pair of shorts in patches. The pair of shorts has a first and a second design permanently applied to an outer surface of the shorts. When dry, the dye coating masks the first design and highlights the second design. When wet, the dye coating masks the second design and highlights the first design.

It is important for ink or dye coating 11 to be permanently applied to body 7 of article 9. This feature maintains the long term functionality of the specialized article of clothing 9. A non-water base ink or dye or other water resistant ink or dye should preferably be utilized to prevent the dye coating from running or evaporating. Non-permanent inks or dyes can be used as a low cost alternative if long term functionality of article 9 is not necessary.

Figure 3:
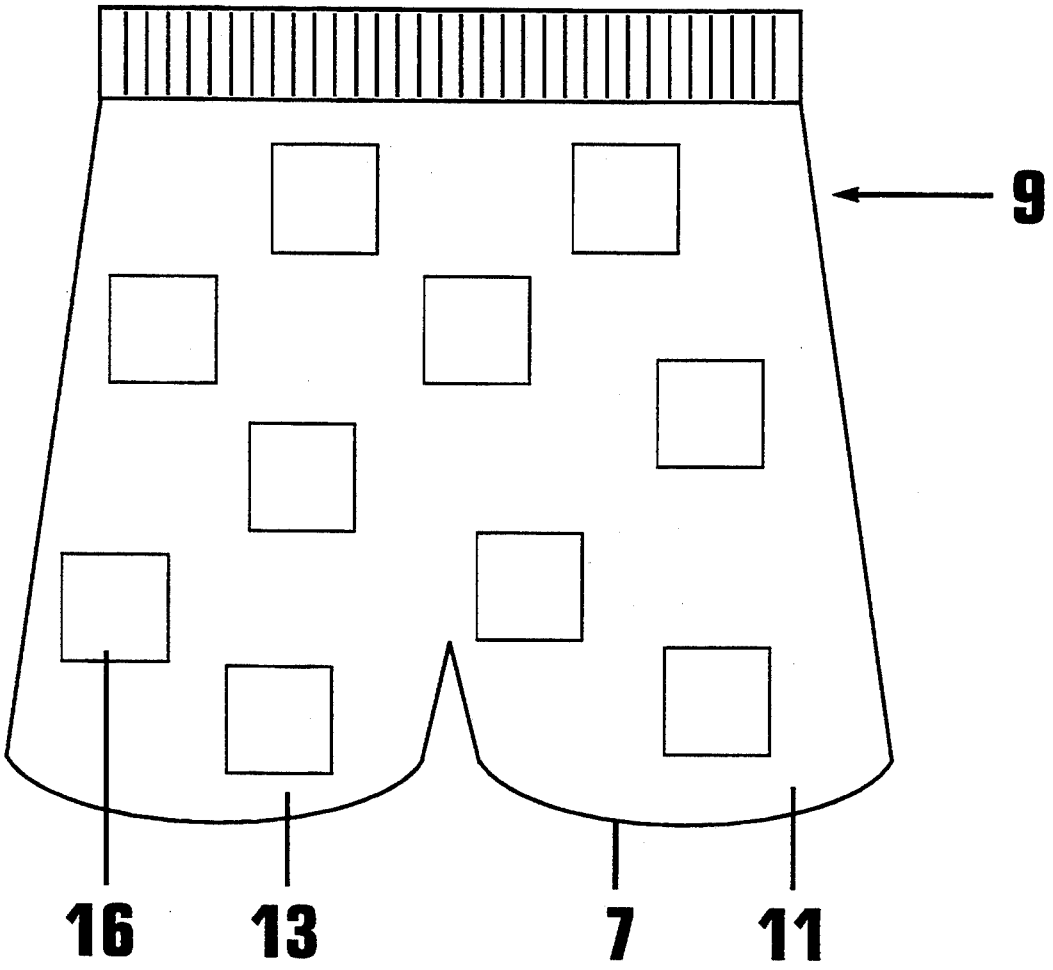
FIG. 3 is an illustration of the inner surface of the article of clothing of FIG. 1 and FIG. 2.

As shown in FIG. 3, everything previously recited can identically be applied to an inner surface 13 of article 9. This allows more flexibility in design, thus creating a double sided or reversible article of clothing. This further allows one single article 9 to yield up to four different faces, thus giving the user the appearance of having four different articles of clothing. FIG. 3 discloses a third design 16 upon inner surface 13.

Article 9 can further be designed to yield many different colors as article 9 becomes more saturated. Dye or ink coating 11 can be utilized to make many different visible designs, colors, or combinations thereof, as article body's 7 moisture content varies between absolute dryness to complete saturation. At specific moisture levels within body 7, the moisture sensitive dye coating 11 can be "set" to a responsive predetermined color.

Article 9 has many applications, including use as a swimsuit, bathing suit, scuba diving suit, surfing suit, or other water sports uniform. It can also be worn as a formal or casual garment that is unrelated to water sports.

Although specific features of this invention are shown in some drawings and not others, this is for convenience only as some feature may be combined with any or all of the other features in accordance with this invention.

Other embodiments will occur to those skilled in the art and are within the following claims:

I claim:

1. An article of clothing, comprising:

a. a body having an outer surface; and b. a moisture sensitive colored coating disposed upon the outer surface of the body, wherein the color of said coating changes when in contact with varying moisture levels in the body, said moisture sensitive coating including a plurality of distinct moisture sensitive dyes, each disposed upon distinct portions of the outer surface of said body, thereby creating a moisture sensitive color change that varies about the outer surface of said body.

2. The article of clothing of claim 1, in which said body is comprised of fabric.

3. The article of clothing of claim 1, in which said body is comprised of rubber.

4. The article of clothing of claim 1, in which said moisture sensitive coating is an ink comprised of an inorganic hydrate compound in microbead form.

5. The article of clothing of claim 1, in which said variable moisture sensitive dye coating is disposed upon the fabric body such that it yields a first design when wet and second design when dry.

6. The article of clothing of claim 1, in which said variable moisture sensitive coating is disposed upon the fabric body such that it yields a plurality of designs that are visible at distinct moisture levels in the fabric body.

7. The article of clothing of claim 1, in which said moisture sensitive coating is disposed below the outer surface such that it permeates through the fabric body to an inner surface of the fabric body.

8. The article of clothing of claim 1, in which said moisture sensitive coating is permanent.

9. A bathing sail, comprising:

a. a fabric body with an outer surface;

b. a first design permanently disposed upon the outer surface of said fabric body;

c. a moisture sensitive coating disposed upon both the outer surface of said body and said first design, wherein said coating changes color when exposed to varying moisture levels in the fabric body; and a second design permanently disposed upon said outer surface and below said moisture sensitive coating, said second design visible only when the fabric is saturated with water.

10. The bathing suit of claim 9, in which said first design is visible only when said fabric body is saturated with water.

11. The bathing suit of claim 9, in which said first design is visible only when said fabric body is dry.

12. The bathing suit of claim 9 further having a plurality of permanent designs disposed upon the outer surface and below said moisture sensitive coating, where said plurality of designs are visible at distinct moisture levels in the fabric body.

13. The bathing suit of claim 9, in which said design is a picture.

14. The bathing suit of claim 9, in which said moisture sensitive dye is permanent.

* * * * *